US008864401B2

(12) United States Patent
Duru

(10) Patent No.: US 8,864,401 B2
(45) Date of Patent: Oct. 21, 2014

(54) HEATING PACKAGING AND APPLICATION DEVICE FOR COSMETIC PRODUCT

(75) Inventor: Nicolas Duru, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 13/821,679

(22) PCT Filed: Sep. 9, 2011

(86) PCT No.: PCT/EP2011/065624

§ 371 (c)(1),
(2), (4) Date: May 14, 2013

(87) PCT Pub. No.: WO2012/032148

PCT Pub. Date: Mar. 15, 2012

(65) Prior Publication Data

US 2013/0223913 A1 Aug. 29, 2013

Related U.S. Application Data

(60) Provisional application No. 61/383,367, filed on Sep. 16, 2010.

(30) Foreign Application Priority Data

Sep. 10, 2010 (FR) ..... 10 57204

(51) Int. Cl.

| | |
|---|---|
| ***A46B 11/08*** | (2006.01) |
| ***A45D 40/26*** | (2006.01) |
| ***A45D 34/04*** | (2006.01) |
| *A45D 40/00* | (2006.01) |

(52) U.S. Cl.

CPC ..... *A45D 40/26* (2013.01); *A45D 2200/155* (2013.01); *A45D 2200/157* (2013.01); *A45D 2040/0012* (2013.01); *A45D 40/00* (2013.01); *A45D 34/04* (2013.01)

USPC ..... 401/265; 401/1; 401/2

(58) Field of Classification Search

CPC ..... A45D 2200/15; A45D 2200/152; A45D 2200/155; A45D 2200/157; A45D 2200/1009; B43M 11/06

USPC ..... 401/1, 2, 261, 263, 265, 266

See application file for complete search history.

(56) References Cited

U.S. PATENT DOCUMENTS 2,285,105 A * 6/1942 Bacher ..... 601/113
6,311,868 B1 11/2001 Krietemeier et al.

(Continued)

FOREIGN PATENT DOCUMENTS

FR 2 913 319 9/2008
FR 2 927 233 8/2009

(Continued)

OTHER PUBLICATIONS

International Search Report for corresponding International Patent Application No. PCT/EP2011/065624, dated Dec. 23, 2011.

(Continued)

*Primary Examiner* — David Walczak

(74) *Attorney, Agent, or Firm* — The Marbury Law Group, PLLC

(57) ABSTRACT

A packaging and application device for a cosmetic product includes a receptacle for packaging the cosmetic product that has an outlet orifice, an application member having a plate forming an application surface for the product, a tube extending from the face of the plate opposite to the application surface to the receptacle so as to define a delivery duct leading on the one hand to the application surface and on the other hand into the receptacle, and an electrical heating element. The electrical heating element is a heating resistive wire mounted at least partly around the tube defining the delivery duct.

18 Claims, 2 Drawing Sheets

(56) References Cited

U.S. PATENT DOCUMENTS

| | | | | |
|---|---|---|---|---|
| 7,938,128 | B2 * | 5/2011 | Gueret | 132/200 |
| 2005/0031400 | A1 | 2/2005 | Marcotte et al. | |
| 2008/0143214 | A1 | 6/2008 | McNamara et al. | |
| 2008/0216857 | A1 | 9/2008 | Tranchant et al. | |
| 2010/0043817 | A1 | 2/2010 | Haan | |
| 2011/0097133 | A1 | 4/2011 | Duru et al. | |

FOREIGN PATENT DOCUMENTS

| | | |
|---|---|---|
| WO | 2007143370 | 12/2007 |
| WO | 2007143430 | 12/2007 |
| WO | 2011015940 | 2/2011 |
| WO | 2012032149 | 3/2012 |

OTHER PUBLICATIONS

Written Opinion from the International Searching Authority for corresponding International Patent Application No. PCT/EP2011/065624, dated Dec. 23, 2011.

International Search Report for International Patent Application No. PCT/EP2011/065625, dated Dec. 23, 2011.

Written Opinion from the International Searching Authority for International Patent Application No. PCT/EP2011/065625, dated Dec. 23, 2011.

* cited by examiner

HEATING PACKAGING AND APPLICATION DEVICE FOR COSMETIC PRODUCT

This is a national stage application of PCT/EP2011/065624, filed internationally on Sep. 9, 2011, which claims priority to U.S. Provisional Application No.61/383,367, filed on Sep. 16, 2010, as well as to French Application FR 1057204, filed on Sep. 10, 2010, the entire contents each of which is incorporated herein by reference.

The present invention relates to a device for the application of a cosmetic product.

More precisely, the subject of the invention is a device comprising an applicator comprising a heating element.

"Cosmetic product" means any composition as defined in Directive 93/35/EEC of the Council of 14 Jun. 1993.

Devices exist that have application elements that it could be useful to be able to heat in a relatively uniform manner in order, for example, to make the application and/or the withdrawal of the product easier or to obtain new properties for the application.

Through application WO 2007/143370, a packaging and application device for a cosmetic product is known that comprises a heating element in the form of a resistive wire placed inside the product reservoir. This heating element makes it possible to heat the product before it is delivered. However, such a device does not make it possible to heat the product in the delivery channel, and does not make it possible to heat an element forming an application surface thus making it possible to keep the product at a temperature higher than the ambient temperature once it has left the device.

There is a need to allow the application of a cosmetic product with the aid of a heating applicator with a design that is relatively simple, energy-saving and adapted to keep the product at a sufficient temperature for its application.

The object of the present invention is therefore to provide an improved device for the application of a cosmetic product in order to alleviate the aforementioned drawbacks.

Accordingly, the invention proposes a packaging and application device for a cosmetic product, comprising a receptacle for packaging the cosmetic product, comprising an outlet orifice, an application member having a plate forming an application surface for the product, and a tube extending from the face of the plate opposite to the application surface to the receptacle so as to define a delivery duct leading on the one hand to the application surface and on the other hand into the receptacle, and an electrical heating element.

According to the invention, the electrical heating element is a heating resistive wire mounted at least partly around the tube defining the delivery duct.

Advantageously the invention allows the product to be heated in advance when it passes into the tube and then to maintain its temperature in contact with the application surface that is also warm.

According to other features of the invention, the resistive wire may form a helical winding about the tube.

The application member may have several delivery tubes. In this case, the resistive wire may form a single helical winding about all of the tubes. The resistive wire may form a helical winding about each of the tubes. The resistive wire may extend substantially in a plane coiling about the tubes.

The tube and the plate forming the application surface may be made in one piece of a material with a thermal conductivity higher than 1 $W \cdot m^{-1} \cdot K^{-1}$.

The tube and the plate forming the application surface may be made of metal and/or of silicone.

The invention will be able to be better understood on reading the following description of non-limiting examples of embodiment of the latter with reference to the appended drawings in which:

FIG. 1 shows an example of a packaging and application device 1 for a cosmetic product.

This device 1 comprises a receptacle 2 via which the user can hold the device so as to serve as a member for gripping the device, and an application member 3 for a cosmetic product P. The product P is contained in the receptacle 2. The formulation of the product P is for example suitable for application when warm, the product comprising for example ingredients that are reactive to a source of heat. The device 1 may also comprise a cap 10 that is removably attached to the receptacle or to the application member and makes it possible to protect the application surface by covering it.

Figure 1:
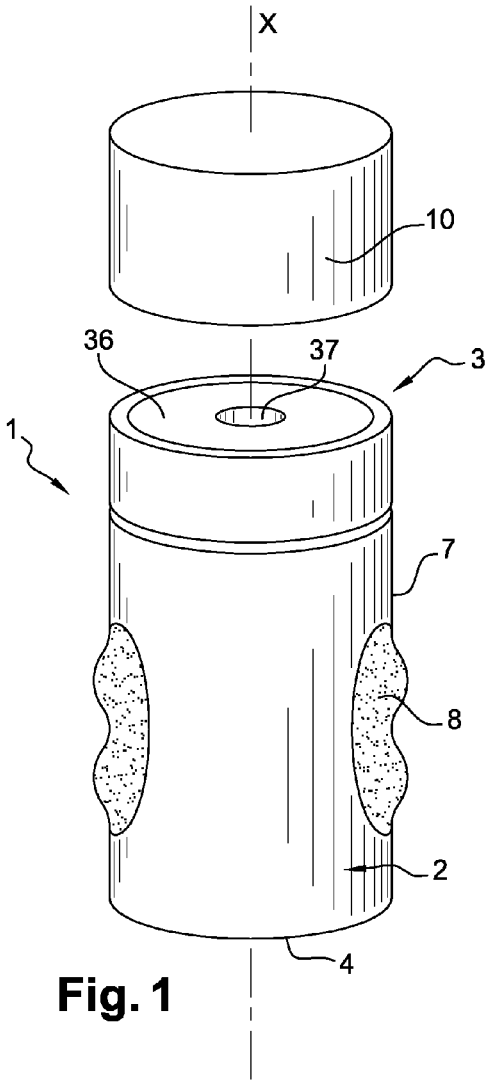
FIG. 1 represents an example of a device for the application of a product according to the invention.
Figure 2:
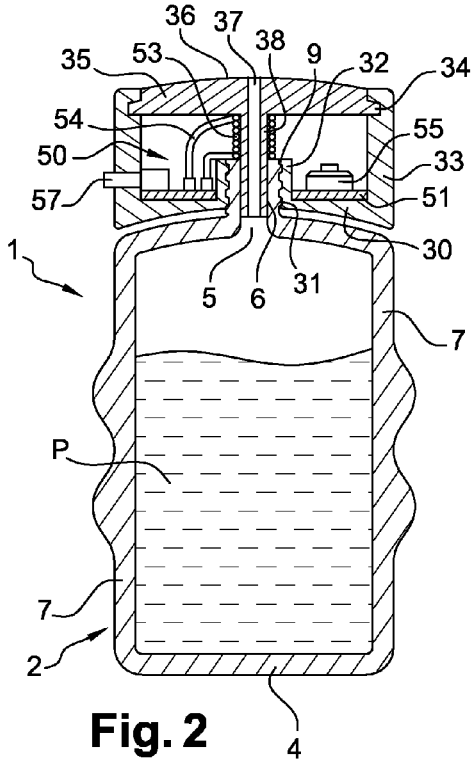
FIG. 2 represents a longitudinal section of the device of FIG. 1.

With reference to FIGS. 1 and 2, the receptacle 2 of the device is for example a hollow body extending mainly along a longitudinal axis X. The receptacle 2 is for example mainly cylindrical but other shapes may of course be envisaged.

The receptacle is closed at one end by a bottom 4. The opposite end to the bottom 4 which forms the top portion of the receptacle comprises an outlet orifice 5 defined by a neck 6 of which the cylindrical outer wall comprises for example a thread 9 or a rib.

The lateral walls 7 of the receptacle may be adapted to receive the fingers of a user for example by comprising recesses, corrugations and/or a non-slip coating 8. Thus the receptacle 2 can be used as a member for gripping the device 1. The lateral walls 7 of the receptacle may be made of a flexible material such as polyethylene (PE) so that the user can press the walls of the receptacle in order to reduce its internal volume and expel the product P from the receptacle through the outlet orifice 5.

The application member 3 is suitable for being attached to this receptacle. Accordingly, the application member 3 comprises a base 30 complementary to the top portion of the receptacle 2. The base 30 is for example circular and comprises an orifice 31 at its centre about which a cylindrical internal skirt 32 extends from the base travelling away from the receptacle 2. The internal skirt 32 comprises attachment means suitable for being connected to the neck 6 of the receptacle 2. For example, the internal skirt 32 comprises a thread to match the thread 9 of the neck of the receptacle so that the application member can be attached to the receptacle by screwing. It can also be envisaged to attach the application member to the receptacle by the snap-fitting of a rib of the neck 6 into a groove of the internal skirt 32. The application member may also be connected to the gripping member by any other attachment means such as mounting by a tight fit, bonding or other means.

The application member 3 also comprises a peripheral skirt 33 extending from the outer edge of the base 30 for example in line with the lateral walls 7 of the receptacle 2. The free end of the internal face of the peripheral skirt 33, that is to say the end opposite to the base 30, has a notch 34 for attaching an application element 35.

The application element 35 comprises a plate defining the application surface 36 of the product P of the application member 3. The application surface 36 extends for example substantially perpendicularly to the longitudinal axis X but it may also extend on another plane for example by forming for example an angle relative to the axis X as in FIG. 3.

This application surface 36 may, for example, take the form of a substantially flat circular surface. The application surface may also be polygonal, oval or any other shape suitable for the said application.

Figure 3:
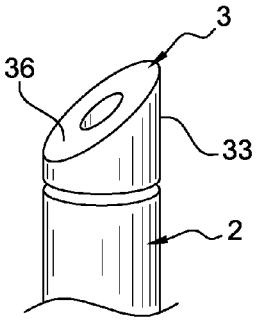
FIG. 3 represents a variant of the device of FIG. 1.

The surface may thus be adapted to the use of a cosmetic product, such as a lipstick, a lip gloss, a mascara, or a foundation. Thus an application element 35 is shown in FIG. 3 comprising an application surface that is beveled, that is to say forming an angle relative to the longitudinal axis X for the application of a product to the lips.

The application surface 36 may also have reliefs making it possible to massage the skin notably in order to improve the application.

The application surface 36 of the application member 3 may have sustained a forming and/or a surface treatment. For example, the application surface 36 may have a corrugated shape. The application surface 36 may also for example be polished. Other shapes may also be envisaged such as striated, flattened, concave or convex shapes, and other treatments such as flocking or a treatment designed to make the surface rough or porous.

The edge of the plate is suitable for being attached in the attachment notch 34 of the peripheral skirt 33.

The application element 35 has a delivery orifice 37 leading to the application surface 36.

The application element 35 also comprises a tube in the form of a duct 38 about the delivery orifice 37, this tube 38 extending axially from the plate away from the application surface 36. The cylindrical tube 38 has an external diameter substantially equal to the diameter of the outlet orifice 5 of the receptacle 2. Thus the tube 38 can be fitted into the neck 6 forming the outlet orifice so as to form a channel leading on the one hand into the receptacle 2 and on the other hand onto the application surface 36 through the delivery orifice 37 of the plate.

As a variant, the cylindrical tube 38 has an internal diameter substantially equal to the external diameter of the neck 6 of the receptacle 2. Thus the tube 38 can be fitted or snap-fitted onto the neck 6 forming the outlet orifice.

The application member may be fully or partially made of metal, silicone, thermoplastic or any other material. Preferably, at least the application element 35 of the application member 3 is made of a material having a good thermal conductivity that is to say greater than 1 $W \cdot m^{-1} \cdot K^{-1}$. For example, the application element 35 can be made entirely of metal such as aluminium or stainless steel.

An electrical device 50 is placed between the base 30 and the plate of the application element 35. The electrical device 50 is for example attached to the base 30 in a manner that may or may not be removable. For example, the device is bonded to the base.

This electrical device comprises a printed circuit 51. For example, the printed circuit 51 is suitable for being housed on the base. Accordingly, it has a circular shape and comprises a hole 52 at its centre allowing the passage of the internal circular skirt of the application member.

The electrical device comprises a heating resistive wire 53 connected by conductive elements 54 to an electrical power supply 55. Thus the heating resistive wire 53 gives off heat when an electric current passes through it.

The heating resistive wire 53 can be supplied with DC current directly by the power supply 55 or by means of a controller (not shown) of the printed circuit regulating for example the intensity of the current passing through the heating resistive wire.

Figure 4:
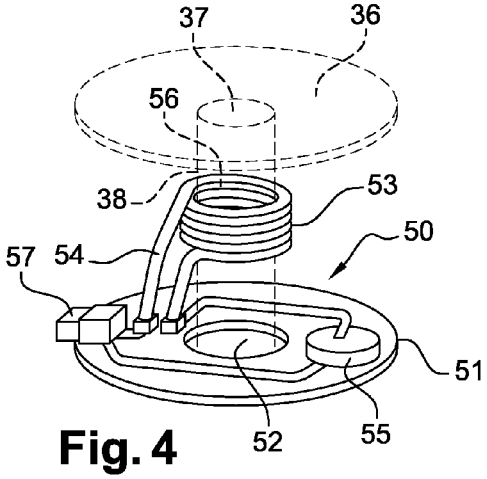
FIG. 4 represents the electrical device of the device of FIG. 1.

The heating resistive wire 53 may be wound helically forming turns about the duct 38 of the application element 35. The winding is understood to be from the plate to the neck 6 of the receptacle 2, over the portion 56 of the duct 38 that is not inserted into the outlet orifice 5 of the receptacle 2. The winding may comprise between 1 and 20 turns: for example, FIGS. 2 and 4 represent a 6-turn winding.

As a variant not shown, the resistive wire 53 may be positioned against the surface of the plate opposite to the application surface 36. The wire may then be wound in a spiral or may be coiled at random against this surface.

In all the variants, the heating wire 53 may be bonded to the application element by means of a thermal bond having for example a high thermal conductivity, that is to say greater than 1 $W \cdot m^{-1} \cdot K^{-1}$, even better greater than 5 $W \cdot m^{-1} \cdot K^{-1}$. As an example, it is possible to use the adhesive referenced 707 from the company EPOTECNY® which advantageously conducts heat with a thermal conductivity greater than 1 $W \cdot m^{-1} \cdot K^{-1}$, while being electrically insulating.

The power delivered by the heating wire 53 may be between 0.2 W and 3 W.

The resistive wire may be manufactured on the basis of an alloy consisting of various metals, for example copper-nickel, nickel-iron, nickel-chromium or iron-chromium-aluminium. As an illustration, the company Kanthal® offers, under the commercial reference Nikrothal® 80, a resistive wire that is suitable for the device of the invention.

Since the application element 35 is made of a good heat-conducting material, the heat provided by the heating resistive wire 53 wound over the portion 56 of the duct is diffused to the plate so that the application surface 36 is also heated, and to the end of the duct 38 inserted into the neck 6 of the receptacle 2 so that the whole duct is heated.

In the case of the variant in which the heating resistive wire 53 is positioned against the surface of the plate opposite to the application surface 36, the heat provided by the heating wire 53 to the plate is diffused to the duct so that the whole duct is heated.

Thus the product P coming out of the receptacle 2 is first heated when it passes into the duct 38 and then placed in contact with the user by the application surface which is also warm. In this manner, the product P can be applied in an optimal manner, the assimilation of the product P by the user is improved and/or characteristics of the product P appear from a certain temperature threshold of the product.

The electrical device 50 may comprise a switch 57 making it possible to selectively power the heating resistive wire 53 from the electrical power supply 55.

For example, the switch 57 is mounted on an outer edge of the printed circuit 51 and protrudes through a through-orifice on the outer surface of the peripheral skirt 33 of the application member 3 so that it can be activated by the user.

The device 1 may comprise a system for regulating the temperature of the application element 35, this regulation system being for example a controller installed on the printed circuit. For example, the regulation system may use a programmed timer of the power supply of the heating resistive wire.

The regulation system may also be connected to a temperature sensor situated close to or in contact with a portion of the application element 35 and making it possible to supply or not supply power to the heating element as a function of a temperature setpoint programmed in the regulation system. The temperature sensor is for example of the thermistor type.

Such a device is used in the following manner. The user removes the cap 10 from the device 1 and activates the heating of the resistive wire 53 by moving the switch 57 into its closed position in which the current from the power supply 55 can pass through the resistive wire 53.

When the application surface 36 is warm enough for the application, the user can deliver the product P from the receptacle 2 to the application surface 36. The product P can flow through the delivery duct 38 by the effect of gravity when the delivery orifice 37 is pointing downwards. In the case of a receptacle with flexible walls, the product may also flow through the delivery orifice 37 by pressing the walls of the receptacle so as to reduce its internal volume and to thus expel the product P out of the receptacle.

The user may then apply the product, warmed as it passed through the duct and onto the warm application surface, to the desired location.

In order to determine whether the application surface is warm enough, the device may comprise a light indicator not shown which comes on or changes colour or switches from a blinking mode to a steady mode in order to indicate that the application temperature threshold is reached. As a variant, the application surface may comprise a disc of heat-sensitive paint which changes colour when the application temperature threshold is reached.

Figure 5:
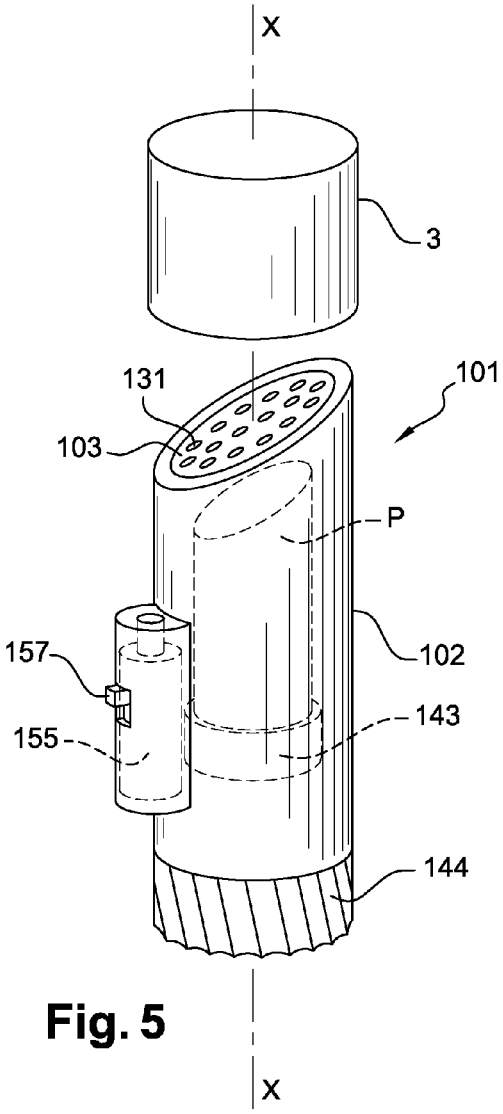
FIG. 5 represents an exemplary variant of a device for the application of a product according to the invention.
Figure 6:
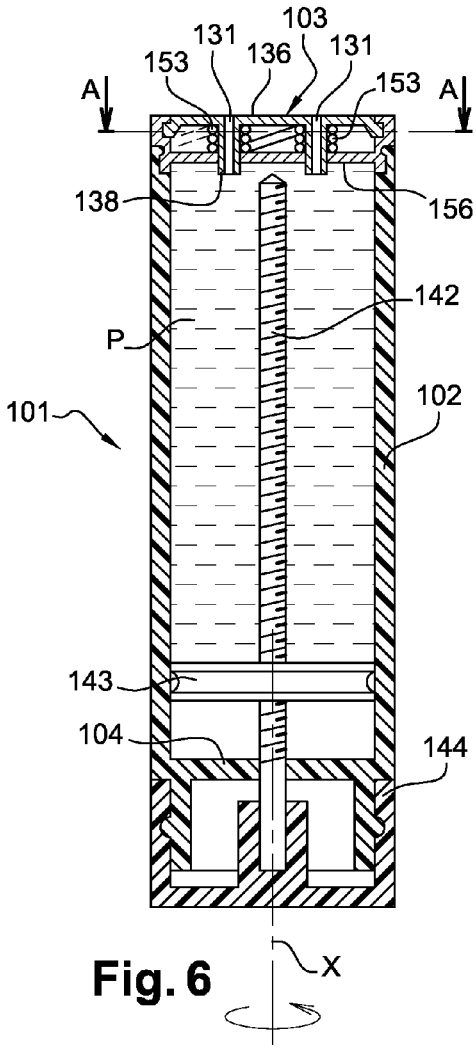
FIG. 6 represents a longitudinal section of the device of FIG. 5.

A variant of a device according to the invention is shown in FIGS. 5 and 6.

This device 101 for delivering a product P of liquid, pasty or solid consistency such as a lipstick composition comprises a main body formed of a reservoir 102 of generally cylindrical shape containing the product P. The reservoir 102 comprises, at its top portion, an application end-piece 103.

This application end-piece 103 has an application surface comprising a multitude of delivery orifices 131 in communication with the reservoir 102.

The device comprises a mechanism for moving the product P.

For example, the mechanism may be a pushing mechanism or a rotation mechanism. The device shown comprises a rotation mechanism.

The reservoir 102 comprises a circular bottom 104 furnished with a central hole traversed by a threaded control rod 142. A piston 143 comprising an internally threaded passageway is mounted on the threaded rod 142, this piston being capable of sliding in translation inside the reservoir 102 under the action of the rotation of the control rod 142 in order to cause the product P to be expelled. The rod 142 is actuated by a control thumbwheel 144 mounted so as to rotate freely on a cylindrical skirt supported by the bottom 104. The thumbwheel 144 comprises a central shaft of cylindrical shape in which a free end of the rod 142 is attached. The thumbwheel 144 also comprises a cylindrical skirt surrounding the skirt supported by the bottom 104. The skirts are furnished with a snap-fitting system consisting of a pair of annular rib/annular swelling interacting with one another so that the thumbwheel 144 remains free to rotate.

According to the invention, the end-piece 103 comprises an electrical device which makes it possible to heat the portion of product in contact with the end-piece 103 by means of a heating resistive wire 153 prior to the application of the product on the keratinous materials, for example the skin or the lips.

The end-piece 103 is formed of a plate comprising orifices and ducts 138 extending axially away from the application surface and emerging on the one hand in the receptacle and on the other hand on the application surface 136 through the orifice of the plate.

The heating resistive wire 153 is placed facing the plate on the side opposite to the application surface.

The resistive wire is for example made of nickel-chromium with a diameter of 0.14 mm, a total resistivity of 1Ω.

Figure 7:
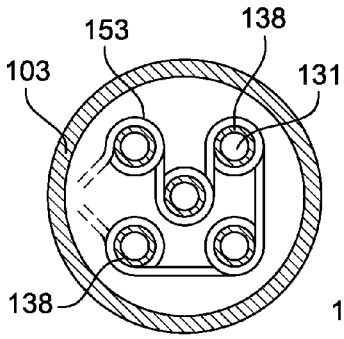
FIGS. 7 to 9 represent variant installations of the heating wire of the device of FIG. 6 in a view in cross section along the axis A-A.

The resistive wire 153 is for example wound helically forming turns about each duct 138 as shown in FIG. 7.

Figure 8:
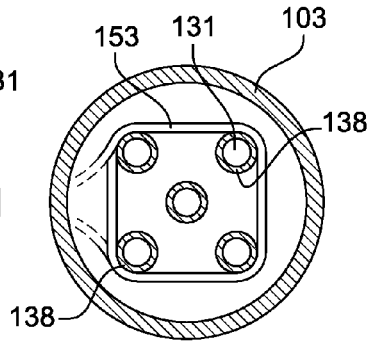

The resistive wire may also be wound helically forming turns about all the ducts 138 as shown in FIG. 8.

Figure 9:
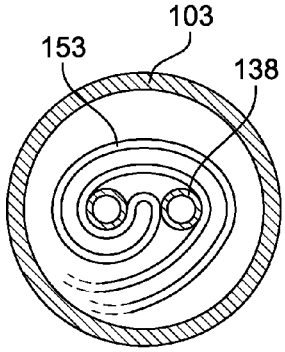

The resistive wire may also be coiled in one and the same plane passing notably partially in contact with the ducts 138 as shown in FIG. 9. In this case, the resistive wire may be positioned either against the plate in order to heat the application surface optimally or against the intermediate part 156 in order to optimally heat the product in the reservoir ready to be delivered, or in an intermediate position.

An intermediate part 156 comprising holes allowing the passage of the ducts 138 from the plate towards the receptacle is attached between the receptacle 102 and the heating resistive wire 153.

The heating wire 153 thus makes it possible to heat a portion of product in the receptacle to a depth of less than 5 mm, while heating the product in the ducts 138 and on the application surface 136.

The heating wire 153 is connected to an electrical power supply source 155 housed for example in the main body of the device 101 which may for example comprise an adapted housing on its peripheral surface as shown in FIG. 5.

The heating application end-piece 103 comprises orifices through which the product P, softened and therefore turned viscous or fluid under the effect of the heat, can travel easily whereas it could do this not at all or with difficulty in solid or pasty form.

The number of orifices may be between 2 and 100, and their section may be less than 5 $mm^2$ or even less than 2 $mm^2$ or again less than 1 $mm^2$.

This device makes it possible to economize on the energy stored in the electrical power supply source by heating only the necessary quantity of product, for example for the application on the lips or the skin.

The invention is not limited to the illustrated examples. The features of the various examples may notably be combined in variants not illustrated.

The expression "comprising a" must be understood to mean "comprising at least one" unless the contrary is specified.

The invention claimed is:

1. A packaging and application device for a cosmetic product, comprising:

a receptacle for packaging the cosmetic product comprising an outlet orifice, an application member comprising a plate forming an application surface for the product, a first delivery orifice in the application surface, and a first tube extending longitudinally from the first delivery orifice in the application surface directly to the receptacle outlet orifice so as to define a first delivery duct between the application surface and the receptacle outlet orifice, and an electrical heating element;

wherein the electrical heating element is a heating resistive wire mounted at least partly on a longitudinally extending portion of an exterior of the first tube defining the first delivery duct.

2. The device of claim 1, wherein the resistive wire forms a helical winding about the first tube.

3. The device of claim 1, wherein the receptacle comprises a plurality of outlet orifices; and the application member includes a corresponding plurality of delivery orifices and a corresponding plurality of tubes.

4. The device of claim 3, wherein the resistive wire forms a single helical winding about the plurality of tubes.

5. The device of claim 3, wherein the resistive wire forms a helical winding about each of the plurality of tubes.

6. The device of claim 3, wherein the resistive wire extends substantially in a plane coiling about the plurality of tubes.

7. The device of claim 1, wherein the first tube and the plate forming the application surface are made in one piece of a material with a thermal conductivity higher than 1 $W \cdot m^{-1} \cdot K^{-1}$.

8. The device of claim 7, wherein the first tube and the plate forming the application surface are made of metal.

9. The device of claim 7, wherein the first tube and the plate forming the application surface are made of silicone.

10. The device of claim 1, further comprising a controller to regulate temperature of the application surface.

11. The device of claim 10, wherein the controller is configured to control the heating element based on signals received from a temperature sensor.

12. The device of claim 11, further comprising an indication element configured to indicate when the application surface has reached a predetermined application temperature.

13. A packaging and application device for a cosmetic product, comprising:

a reservoir configured to contain a cosmetic product;

a translation mechanism for moving a product within the reservoir;

an application member having a plate forming an application surface for the product, the plate including a plurality of delivery orifices to permit the product to exit the reservoir onto the application surface of the application member, a plurality of delivery tubes extending longitudinally between the plurality of delivery orifices in the application surface and a corresponding plurality of outlet orifices in the receptacle, and heating resistive wire mounted at least partly on a longitudinally extending portion of an exterior of each of the plurality of delivery tubes so as to heat the product moving through the delivery tubes.

14. The device of claim 13, wherein the reservoir contains a cosmetic product.

15. The device of claim 13, wherein the translation mechanism is configured to move a product within the reservoir along a longitudinal axis of the reservoir toward the upper portion of the reservoir.

16. The device of claim 15, wherein the translation mechanism is one of a rotational mechanism and a piston mechanism.

17. The device of claim 13, wherein the heating resistive wire forms a single helical winding about the plurality of delivery tubes.

18. The device of claim 13, wherein the heating resistive wire forms a helical winding about each of the plurality of delivery tubes.

* * * * *